US005222879A

United States Patent [19]

Kapadia

[11] Patent Number: 5,222,879

[45] Date of Patent: Jun. 29, 1993

[54] CONTACT-LESS SEAL AND METHOD FOR MAKING SAME

[75] Inventor: Neville D. Kapadia, Davidson, N.C.

[73] Assignee: Ingersoll-Rand Company, Woodcliff Lake, N.J.

[21] Appl. No.: 884,579

[22] Filed: May 18, 1992

[51] Int. Cl.[5] ..... F04B 19/00

[52] U.S. Cl. ..... 417/437; 418/141; 92/162 R; 277/215; 277/53

[58] Field of Search ..... 417/437, 572; 418/141, 418/63; 277/53, 55, 215; 92/162 R

[56] References Cited

U.S. PATENT DOCUMENTS

| | | | |
|---|---|---|---|
| 1,016,561 | 2/1912 | Grabler | 277/53 |
| 4,314,531 | 2/1982 | Bruni | 92/169.1 |
| 4,629,403 | 12/1986 | Wood | 418/63 |

FOREIGN PATENT DOCUMENTS

| | | | |
|---|---|---|---|
| 59-85494 | 5/1984 | Japan | 418/141 |
| 0268893 | 11/1986 | Japan | 418/141 |

OTHER PUBLICATIONS

ASME Article 88-Trib-40, Experimental Results for Labyrinth Gas Seals with Honeycomb Stators, Authors—D. Childs, D. Elrod and K. Hale—Dec. 1988.

ASME Article, Annular Honeycomb Seals, Authors L. Hawkins, D. Childs and K. Hale—Dec. 1988.

*Primary Examiner*—Richard A. Bertsch
*Assistant Examiner*—Charles G. Freay
*Attorney, Agent, or Firm*—Glenn B. Foster; Victor M. Genco, Jr.

[57] ABSTRACT

A contact-less seal apparatus including a first surface and a closely adjacent second surface with a space defined therebetween. A high pressure fluid region exists on a first side of the space. A low pressure fluid region exists on a second side of the space. A plurality of discrete expansion chambers are integrally formed in at least one of the first and second surfaces within the space to limit fluid flow from the high pressure fluid region to the low pressure fluid region. The expansion chambers may be formed on an axial end of a rolling piston, side and end faces of a vane, lateral faces of a reciprocating piston or other elements where a contact-less seal is highly desirable to improve sealing capability and effectiveness.

23 Claims, 4 Drawing Sheets

CONTACT-LESS SEAL AND METHOD FOR MAKING SAME

BACKGROUND OF THE INVENTION

This invention relates to compressible fluid handling apparatus, and more particularly this invention relates to apparatus and method for sealing, without contact, regions of higher pressure from regions of lower pressure typically occurring in the handling of compressible fluids.

Compressible fluid handling apparatus, such as compressors or internal combustion engines, typically subject a compressible fluid, such as air, to a number of working cycles including the intake of a fluid, a subsequent compression of the fluid to a lower volume with higher pressure, and eventual discharge from the apparatus.

Typically, a movable member moving within a bounded volume, such as a cylindrical volume, will, by its movement, progressively shrink the bounded volume within which the fluid is confined to thereby move the fluid from a region of lower pressure to a region of higher pressure, i.e. compress it. Various types of compressed fluid handling apparatus include reciprocating pistons moving in a cylindrical bore, rolling pistons moving eccentrically within a cylindrical casing, and even elliptical rotors moving in epi-trochoidal paths, as in the Wankel rotary engine.

In all these instances, seals are necessary between the moving member and the bounded volume in which it moves to prevent leakage of the compressed fluid from the region of higher pressure to the region of lower pressure. Particularly in those applications, where the maximum pressure differential between the region of highest pressure and the region of lowest pressure is not excessive. The initial and most common types of seals are mechanical contact type seals (gaskets, rotative mechanical contact seals etc.). In compressed fluid handling apparatus utilizing contact type seals, wear and heat buildup are a consideration. In rolling piston designs, for example, use of the mechanical sealing elements limited the size and pressures which could be obtained by prior art configurations. In larger rolling piston compressors for example, too much heat and wear are caused by the seals to produce a long lasting configuration.

The prior art has developed so called contact-less seals which involve no contact between the moving member and its bounded volume, with the attendant benefit of significantly reduced friction.

While there exist a variety of types of prior art contact-less seals, they are essentially comprised of two different types. One type of prior art contact-less seal involves the formation of generally continuous and adjacent grooves, more or less regular, created in either, or both of, the moving member and the stationary bounded volume which are separated, not by contact but instead by a space. Such grooves create, in effect, a "labyrinth" seal with tortuous air passages which impede the flow of the compressible fluid from a region of higher pressure to a region of lower pressure. These labyrinth seals require expensive, and/or extensive, machining operations and have limited capabilities, especially when pressure differentials between regions of high pressure and low pressure become excessive driving the controlling end clearance to become exceedingly small and critical. Labyrinth seals permit fluid flow, within the seals, parallel to the grooves. This type of flow often permits an undesirable passage through the seal from regions of higher pressure to regions of lower pressures.

In an effort to overcome the cost disadvantages and limited capabilities of labyrinth-type seals, the prior art has developed an alternative seal type, known as the so-called "honeycomb" seal. Honeycomb seals are normally created by the formation of hexagonal cells formed through crimping ribbon steel and brazing together to obtain a honeycomb matrix structure which is then cut to shape and then in turn is affixed, or bonded to, either the movable element or to the stationary walls of the bounded volume within which the movable element operates.

Formation of the honeycomb cells as a separate crimped and brazed structure, and the subsequent bonding of such structure to elements of the compressible fluid handling apparatus, first requires additional manufacturing operations and further suffers from the additional disadvantage that over longer periods of service, the bond between the honeycomb structure and its associated member may weaken over time and ultimately fail. Furthermore brazing of the honeycomb structure to its associated member causes severe deformation and thermal stresses.

The foregoing illustrates limitations known to exist in present compressible fluid handling apparatus. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the invention, this is accomplished by providing an apparatus including a first surface and a closely adjacent second surface with a space defined therebetween. A high pressure fluid region exists on a first side of the space. A low pressure fluid region exists on a second side of the space. A plurality of discrete expansion chambers are integrally formed in at least one of the first and second surfaces within the space to limit fluid flow from the high pressure fluid region to the low pressure fluid region.

The foregoing and other aspects of the invention will become apparent from the following detailed description of the invention when considered in conjunction with the accompanying drawing figures.

BRIEF DESCRIPTION OF THE DRAWING FIGURES

DETAILED DESCRIPTION

Figure 2:
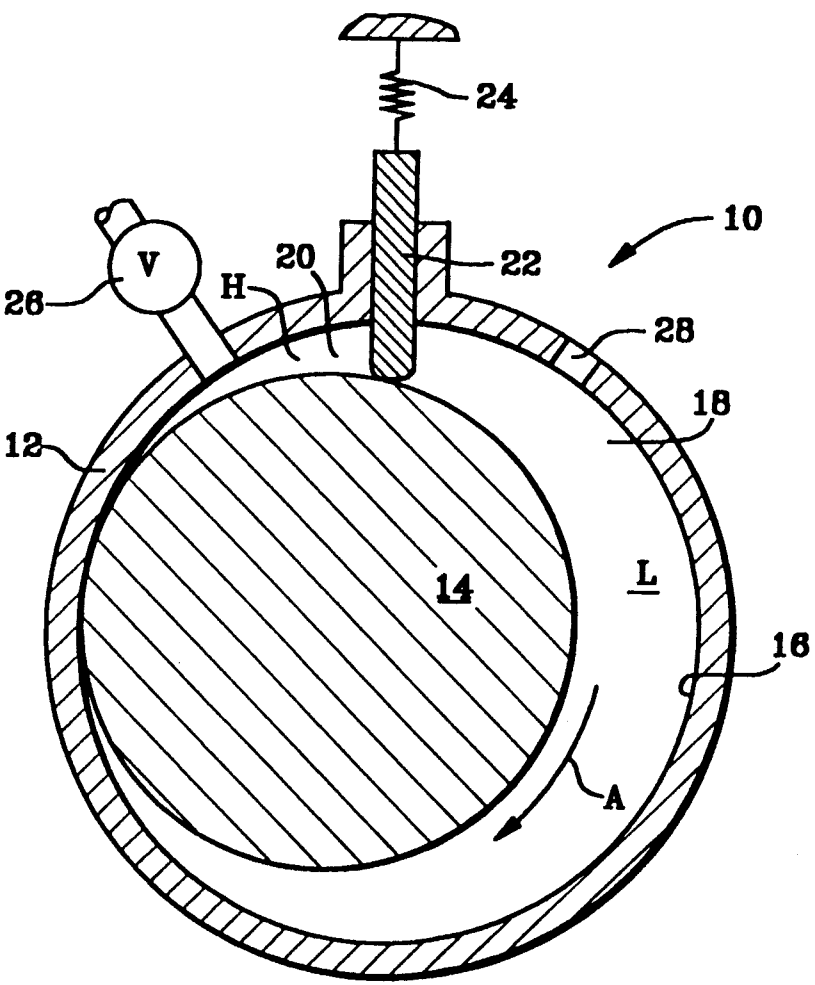
FIGS. 1 and 2 are cross-sectional views illustrating progressive stages of a rolling piston compressor in which an embodiment of the invention may be used.
Figure 1:
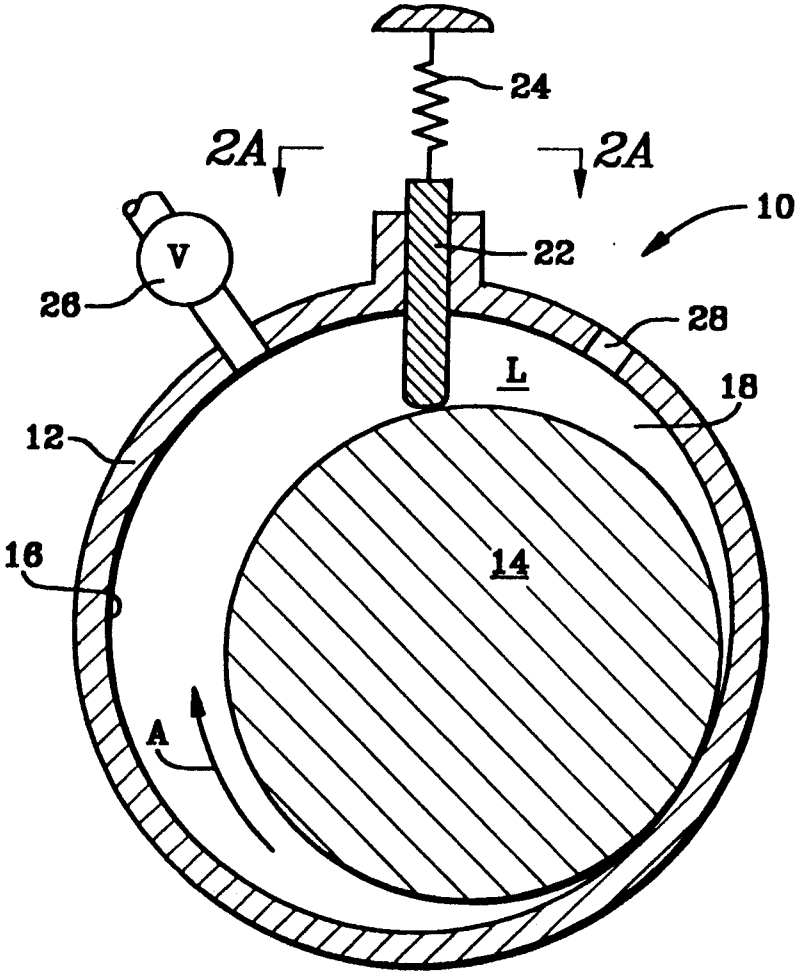

In this disclosure, the term "compressor" is intended to cover pumps, compressors, motors or other devices intended to compress a working fluid. With reference to FIGS. 1 and 2, there is illustrated a rolling piston compressor, generally at 10. Rolling piston compressor 10 comprises a cylindrical casing 12 within which moves an eccentrically mounted rolling piston 14 making rolling contact along the inner cylindrical surface 16 of the casing. The motion of rolling piston 14 is such that it will both revolve around its center (indicated by the arrows A) while the center also undergoes its own rotative motion within the casing 12. In effect, the rolling piston 14 orbits within the casing 12. Further details of the precise driving mechanism to achieve this motion (not shown herein) are disclosed in application Ser. No. PCT/US91/09073, filed Dec. 4, 1991, and application Ser. No. PCT/US91/09074, filed Dec. 4 1991, assigned to the assignee of the instant application. The disclosures of both these copending applications are expressly incorporated herein by this reference.

As rolling piston 14 moves within the casing 12 it functions, by its motion, to shrink the working fluid contained within the uncompressed bounded volume 18, a region L of low pressure as shown in FIGS. 1 and 2, to the compressed bounded volume 20, a region H of high pressure as shown in FIG. 2. To complete the bounded compressed volume 20 a sliding vane 22 is biased by a spring 24. A one-way discharge valve and duct 26 allow expulsion of the compressed fluid so that the compressor can again, in a similar subsequent cycle, take a compressible fluid, such as air, through an intake duct 28 to subject it to another compression cycle.

Figure 2A:
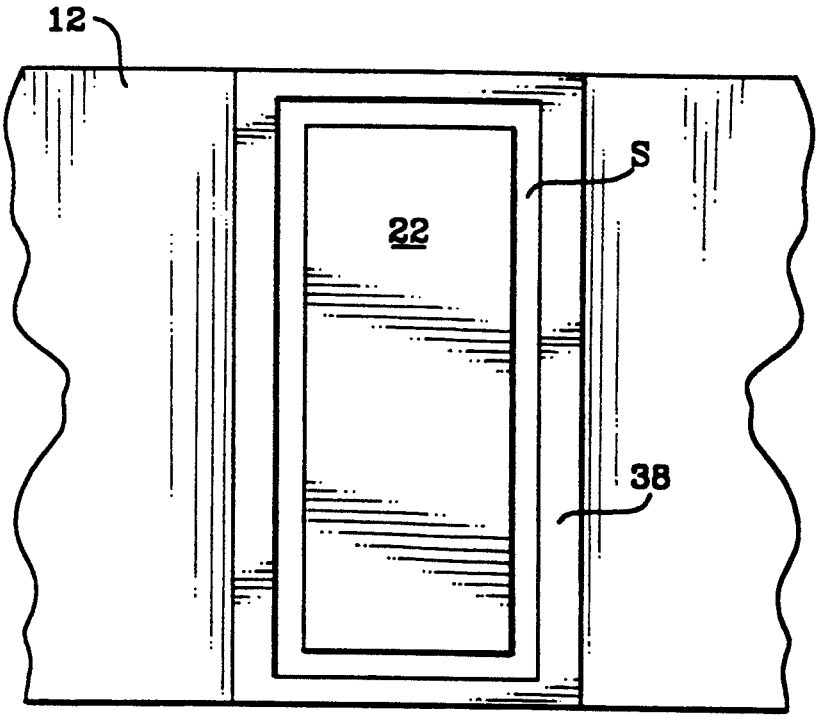
FIG. 2A is a cross-sectional view illustrating an embodiment of the vane structure along the line 2A—2A of FIG. 1.

FIG. 2A shows a cross-sectional top view of the sliding vane 22 which has a generally rectangular shape and which moves in a slot defined by vane guides 38. There is a tendency to reduce contact between adjacent surfaces of the vane 22 and guides 38, as indicated by the space designated S. This is due to the turbulence created by the expansion chambers acting on these adjacent surfaces providing an air cushion in addition to its sealing function.

Figure 3:
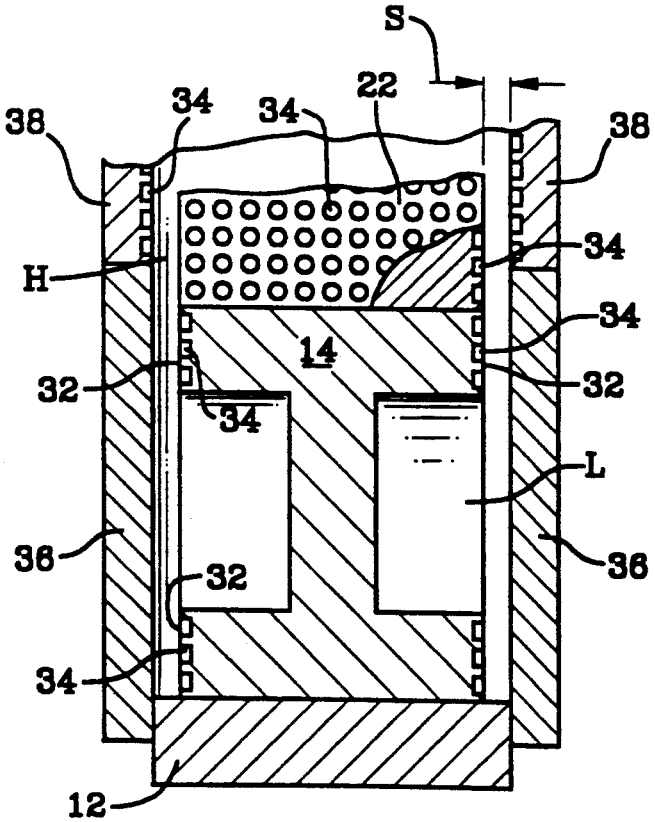
FIG. 3 is a cross-sectional end view illustrating an embodiment of a rolling piston functioning within a rolling piston compressor.

With reference to FIG. 3, there is shown a cross-sectional side schematic view of the rolling piston 14 functioning within casing 12 in which the bounded volume is further defined by side walls 36. Piston 14 has annular end faces 32 in which are integrally formed a plurality of discrete expansion chambers 34, indicated schematically. Expansion chambers 34 may also be formed on several, or all of the surfaces of the sliding vane 22, and these expansion chambers are shown in a preferred form as depressions having a circular, or cylindrical shape such as might be created, for example, by drilling.

As shown in FIG. 3, expansion chambers 34 may also be located in the surfaces of the vane guides 38. The rolling piston 14 does not contact the side walls 36, instead being separated therefrom by a space S, shown grossly exaggerated in the schematic drawing. In practice, the space S may range from two one-thousandths of an inch to ten one thousandths of an inch. With reference to FIGS. 1, 2 and 3, a region H of high pressure is separated from a region L of low pressure by the interposed plurality of discrete expansion chambers 34, formed integrally in at least one of the moving member or stationary parts of the bounded volume defined in a compressible fluid handling apparatus.

In operation, high pressure fluid which encounters the space S suffers a localized pressure drop with an attendant increase in the velocity of the high pressure fluid, sending a high velocity flow into the expansion chamber 34. When the high velocity flow encounters the bottom of the expansion chamber, a reflected pressure wave is sent back into the space S, creating a localized turbulence whorl which tends to impede further flow from region H to region L. Successive expansion chambers along the direction from region H to region will create successive localized regions of turbulence which is successively somewhat less intense. Thus a progressively decreasing resistance to further flow is offered until the flow of compressed fluid encounters the low pressure region L.

Typical dimensions for the depressions forming the expansion chambers 34 are a diameter of approximately 1.25 mm (when the shape of the depression is circular), with the depth of the depression being on the order of 2 mm. However, diameters as large as 6 mm, with depths as large as 7 mm have also been found to be satisfactory. These dimensions will vary considerably depending upon the scale and configuration of the elements which the sealing is being caused therebetween.

Figure 4:
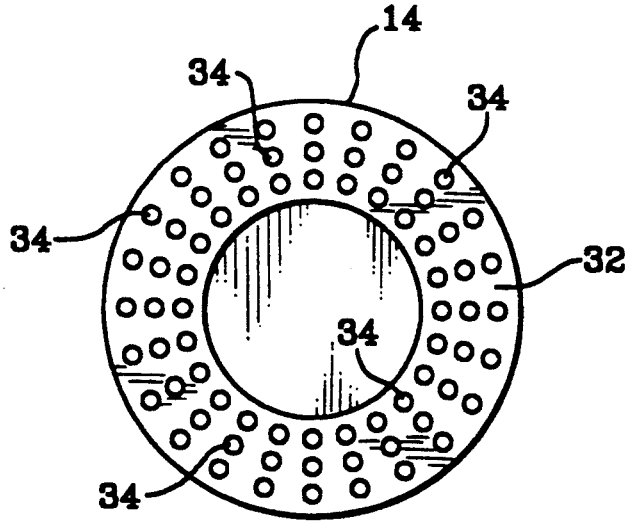
FIG. 4 is a side view illustrating an embodiment of the depressions formed in the side faces of a rolling piston.

With reference to FIG. 4, which shows a side view of the rolling piston 14, there is shown the side face 32 in which the expansion chambers 34 are formed, illustrated in this instance in the shape of a circular depression, as might be formed by drilling.

Figure 5:
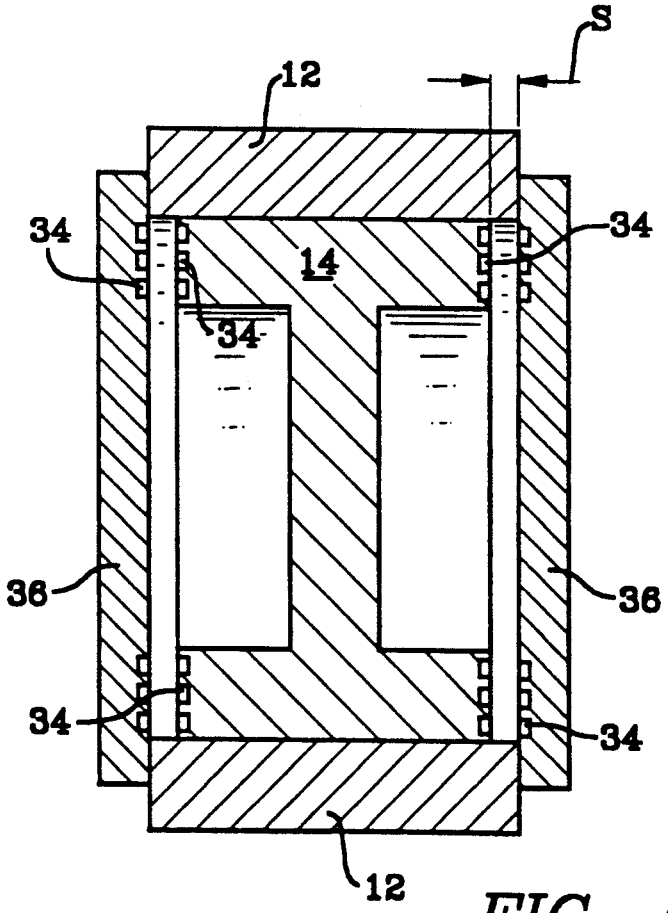
FIG. 5 is a cross-sectional view of a moving piston illustrating an alternative embodiment of the expansion chamber suitable for use in a rotary engine of the Wankel type.

FIG. 5 shows an alternative embodiment of the invention in which parts are structurally similar to those of FIG. 3 (which are identically labeled), except that element 14 represents the rolling piston of a rotary engine of the Wankel type. In such an environment, expansion chambers 34 may be located not only in piston 14 but also in the side walls 36 to cooperatively function as a pressure barrier impeding flow between a region H of high pressure and a region L of lower pressure. In such an embodiment the expansion chambers 34 represent an alternative to the commonly used side seals of a rotary piston in a Wankel type engine.

While the circular shape of the expansion chambers 34 naturally results from a preferred method of forming the chambers (e.g. by drilling) other shapes may be utilized when, for example, casting is employed to form the expansion chambers 34. Similarly, expansion chambers may be formed by chemical etching, electro-discharge machining, electro-chemical machining, pulse laser machining or any of the similar machining techniques well known in the art.

It is to be noted in addition that the formation of expansion chambers in a moving vane associated with a rolling piston compressor allows the vane to be both lighter and more efficiently cooled, due to the increased surface area, by the flow of air across the expansion chambers. Further advantages include the reduction of reciprocating masses with consequent decreases in the power required to displace the vane and piston, and the associated power to drive the compressor.

The expansion chambers permit the material of the vane to flow somewhat when deformation is required.

For example, upon application of heat and the associated thermal expansion to the vane, if a portion of the vane adjacent an expansion chamber comes in contact with the vane guide 38 then the expansion chamber likely will allow the vane to deflect or flow, as required, such that the vane can pass through the vane guide. The expansion chamber may also assist in permitting the vane to be pliable, which is desired considering the different forces which the vane encounters from the vane guide 38, the rolling piston 14 fluid pressure and other elements.

Figure 6:
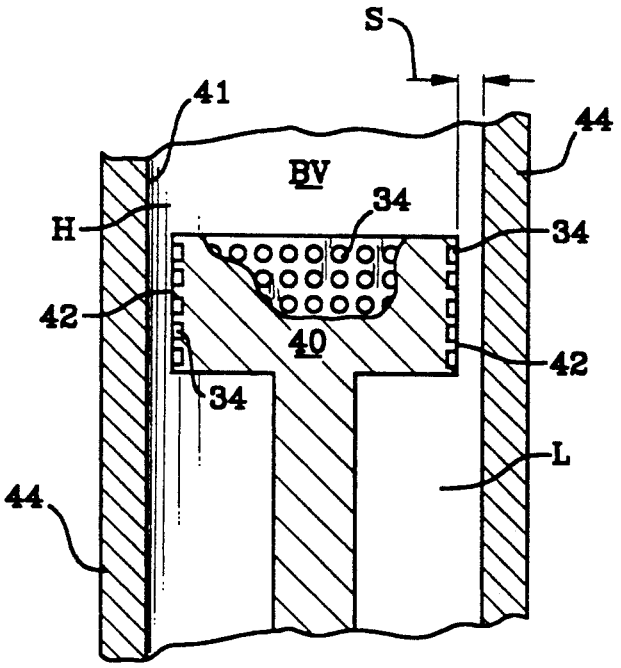
FIG. 6 is an alternative embodiment illustrating the use of the invention with a reciprocating piston in a compressible fluid handling apparatus.

With reference to FIG. 6, an alternative application of the invention is shown as applied to a reciprocating piston 40, reciprocating within a cylindrical bore 41 of a typical bounded volume BV within compressible fluid handling apparatus. The reciprocating piston 40 has piston a skirt 42 which is spaced from the sidewalls 44 of the bore 41. Again, the spacing S between the piston skirt 42 and sidewall 44 is shown grossly exaggerated for purposes of illustration only. Expansion chambers 34 integrally formed in piston skirt 42 function in the aforesaid manner to separate the region H of high pressure from a region L of low pressure and to impede the flow of pressurized fluid between these two regions.

Figure 7:
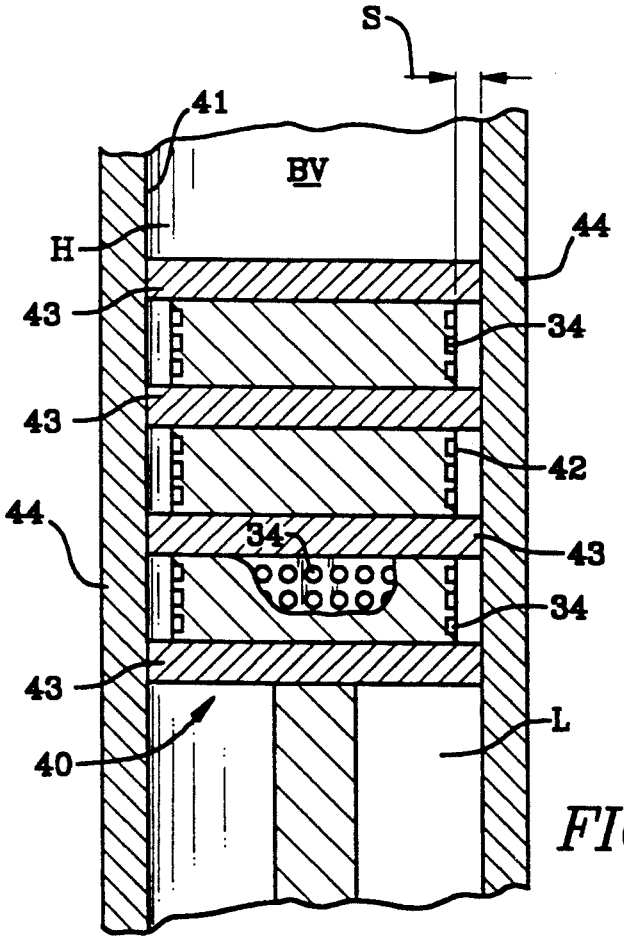
FIG. 7 is yet another alternative embodiment of the invention in a modified reciprocating piston in a compressible fluid handling apparatus.

With reference to FIG. 7, there is shown as in FIG. 6, a reciprocating piston 40, reciprocating within a cylindrical bore 41 of a typical bounded volume BV within compressible fluid handling apparatus. Unlike FIG. 6, the piston skirt 42, in addition to containing integrally formed expansion chambers 34 therein also has spaced along the length thereof a plurality of thrust guide collars 43 which contact the cylindrical bore 41. The thrust guide collars 43 function to absorb lateral thrust of the reciprocating piston 40 within the bore 41 and also function, in a manner analogous to that of some piston rings, in conventional reciprocating pistons, as scrapers to remove deposits from bore 41, such as might exist when the piston 40 functions in an internal combustion engine. The embodiment of FIG. 7 provides an improved "hybrid" seal in which the contact-less seal of the invention is supplemented by at least one thrust guide collar 43 making contact.

It should be noted that while the invention, in its several preferred embodiments, has been illustrated with respect to rotating, or reciprocating, pistons in compressed fluid handling apparatus, the invention is not so limited. Clearly, other types of compressed fluid handling apparatus, such as screw compressors, axial compressors, and Roots blowers can equally well utilize this invention. In fact, whenever there is a space between a region of high pressure and lower pressure which space is defined by adjacent surfaces, a plurality of discrete expansion chambers integrally formed in at least one of the surface will serve to limit fluid flow from the high pressure fluid region to the low pressure fluid region.

Accordingly, this invention provides a novel contact-less sealing technique which is extremely versatile in its scope of applications, is cheaper to manufacture, and will result with a more durable final product than the labyrinth seal and provides a contact-less seal which is easier and simpler to manufacture than the honeycomb seal, and which has greater durability than the honeycomb seal by eliminating all brazing or bonding operations.

While the invention has been particularly shown and described with reference to preferred embodiments thereof, it will be understood by those skilled in the art that the foregoing and other changes in form and details may be made therein without departing from the spirit and scope of the invention, as defined by the claims appended hereto.

Having described the invention, what is claimed is:

1. An apparatus for sealing, without contact, a region of high pressure fluid from a region of low pressure fluid, the apparatus comprising:

bounded volume having at least one wall;

a movable member having at least one sealing surface, the movable member being mounted for operation within the bounded volume, and wherein a space having a fixed dimension is defined intermediate the wall and the sealing surface;

a high pressure fluid region existing on a first side of the space;

a low pressure fluid region existing on a second side of the space; and a plurality of discrete expansion chambers formed on the sealing surface of the movable member to limit fluid flow from the high pressure fluid region to the low pressure fluid region.

2. The apparatus as described in claim 1, and wherein the movable member is a rolling piston of a compressor, the rolling piston having a pair of axially opposed annular end faces, and wherein a plurality of expansion chambers are formed on at least one of the annular end faces.

3. The apparatus as described in claim 1, and wherein the movable member is a rolling piston of a rotary engine of the Wankel type, and wherein a plurality of discrete expansion chambers are formed on the wall of the bounded volume.

4. The apparatus as described in claim 1, and wherein the discrete expansion chambers are each shaped in the form of circular depressions each having a predetermined dimension.

5. In a positive-displacement compressor, an apparatus for sealing, without contact, a region of high pressure fluid from a region of low pressure fluid, the apparatus comprising:

a bounded volume defined by a plurality of walls, the volume provided to contain a compressible fluid;

a piston, having a peripheral surface and at least one sealing surface, movably mounted for travel within the bounded volume and along at least one of the walls thereof to thereby move the compressible fluid from a region of higher volume and lower pressure to a region of lower volume and higher pressure, and wherein a space, having a fixed dimension, is defined intermediate a predetermined surface of the piston and a predetermined wall; and a plurality of discrete expansion chambers formed on a predetermined surface of the piston, the discrete expansion chambers fluidly communicating with the space.

6. The apparatus according to claim 5 wherein the piston orbits within the bounded volume.

7. The apparatus according to claim 6 wherein the bounded volume comprises a cylindrical bore having a centerline and wherein the piston comprises a cylinder having an axis of rotation that is eccentric and parallel to the centerline.

8. The apparatus according to claim 7 wherein said cylindrical bore has two end walls between which the cylinder is disposed in noncontact relation thereto.

9. The apparatus according to claim 5 wherein the piston reciprocates within the bounded volume.

10. The apparatus according to claim 9 wherein the piston has a skirt and at least one thrust guide collar mounted on the skirt, and wherein circular depressions are formed around the periphery, and along the length, of the skirt.

11. The apparatus according to claim 5 wherein the discrete expansion chambers are additionally formed on at least one of the plurality of walls which define the bounded volume.

12. The apparatus according to claim 5 wherein the expansion chambers have the form of a depression having a bottom.

13. The apparatus according to claim 12 wherein the depression is circular.

14. An apparatus as described in claim 5, further comprising:

a casing and a vane movable in said casing; and a plurality of discrete expansion chambers formed on the vane.

15. The apparatus according to claim 14 in which the expansion chambers have the form of a circular depression having a bottom.

16. An apparatus as described in claim 5, further comprising:

a casing, having a vane guiding surface, and a vane movable in said casing; and a plurality of discrete expansion chambers formed on the vane guiding surface.

17. The apparatus according to claim 16 in which the expansion chambers have the form of a circular depression having a bottom.

18. In a compressible fluid handling apparatus having a bounded volume defined by a plurality of walls, and a piston movably mounted within the bounded volume, the piston having a peripheral surface and at least one sealing surface, a method of creating a contact-less seal between a region of higher pressure and a region of lower pressure, the method comprising the steps of:

forming a space having a fixed dimension between the region of higher pressure and the region of lower pressure;

confining said space by at least one of the walls and a predetermined surface of the piston; and forming on a predetermined surface of the piston a plurality of discrete expansion chambers which fluidly communicate with the space.

19. The method of claim 18 further comprising the step of:

forming the discrete expansion chambers in the shape of a depression on a predetermined surface of the piston.

20. The method according to claim 19 in which the discrete depressions are formed as circular depressions.

21. A positive-displacement compressor device comprising:

a housing having a centerline, an inner surface, and at least one wall, the housing provided to contain a compressible fluid;

a slot, having an interior surface, formed int he housing;

a vane, having an exterior surface, slidably disposed in the slot;

a piston having a peripheral surface, at least one sealing surface and an axis of rotation that is parallel to the centerline, the piston mounted for operation within the housing and when mounted therein, a space, having a fixed dimension, is defined intermediate the housing wall and the sealing surface of the piston, and wherein the piston is movable within the housing in a predetermined pattern about the axis of rotation and along the housing inner surface to move a compressible fluid from a region of higher volume and lower pressure to a region of lower volume and higher pressure; and a plurality of discrete depressed expansion chambers formed on the sealing surface of the piston.

22. An apparatus as described in claim 21, and wherein a plurality of discrete depressed expansion chambers are formed on the exterior surface of the vane.

23. An apparatus as described in claim 22, and wherein a plurality of discrete expansion chambers are formed on the interior slot surface.

* * * * *